US005265297A

United States Patent [19]

Gould et al.

[11] Patent Number: 5,265,297

[45] Date of Patent: Nov. 30, 1993

[54] POOL CLEANER WITH IMPROVED ELASTOMERIC VALVE

[75] Inventors: Robert F. Gould, San Francisco, Calif.; Bruce R. Johnson, Fort Lauderdale, Fla.

[73] Assignee: Jandy Industries, Novato, Calif.

[21] Appl. No.: 159

[22] Filed: Jan. 4, 1993

[51] Int. Cl.[5] ..... E04H 3/20

[52] U.S. Cl. ..... 15/1.7; 137/624.14

[58] Field of Search ..... 15/1.7; 137/624.14; 251/5

[56] References Cited

U.S. PATENT DOCUMENTS

| | | | |
|---|---|---|---|
| 4,642,833 | 2/1987 | Stoltz et al. | 15/1.7 |
| 4,742,593 | 5/1988 | Kallenbach | 15/1.7 |
| 4,769,867 | 9/1988 | Stoltz | 15/1.7 |

*Primary Examiner*—Edward L. Roberts
*Attorney, Agent, or Firm*—Corwin R. Horton

[57] ABSTRACT

A vacuum pool cleaning device of the interrupted flow type having a valve in the form of a pair of lips biased to an open position by the inherent elasticity of the plastic material forming a portion or all of the valve in which an auxiliary biasing structure with low creep properties is applied to the lips of the valve and function to compensate for the memory loss during a cycle of operation of the valve in the plastic, due to its relatively high creep properties, by returning the lips substantially to their open position when the operation of the unit is stopped, so that during the at-rest period prior to the next cycle the plastic material can reestablish its memory.

20 Claims, 2 Drawing Sheets

POOL CLEANER WITH IMPROVED ELASTOMERIC VALVE

BACKGROUND OF THE INVENTION

This invention relates to swimming pool cleaning devices which operate automatically to move over the surface to be cleaned when water is induced to flow through the device by the suction created by conventional swimming pool filtration equipment. In these devices water flow in a flow passage through the device is interrupted by a valve mechanism in the passage with the result that the device moves step-wise in random fashion over the pool surfaces. This allows the surfaces to be cleaned by water flowing over such surfaces into and through the device to the filter unit.

Among the various valving arrangements that have been proposed for such cleaning devices U.S. Pat. No. 4,769,867 described a valve in the form of a pair of "jaw-like" members biased to an open position by the inherent elasticity of the plastic material forming a portion or all of the valve. The mode of operation is as follows. When suction is applied to the flow passage water flows through the passage and this reduces the pressure at the internal surfaces of the valve. When the flow velocity reaches a critical value, the valve closes due to the differentially higher pressure on the external surfaces of the valve which overcomes the biasing force maintaining the "jaws" at the open position.

While the described valve has potential advantages of simplicity, relatively compact size and reduced susceptibility to plugging by debris, it has inherent limitations which render it unsatisfactory as it is incapable of achieving the sustained operation required for typical applications in which the cleaner is operated on a daily cycle, usually for daily periods of up to 18 hours or higher. Specifically, it has been found that in operation over time elastomeric material employed to bias the valve to the open position is inherently subject to creep and gradually looses its "memory" such that the "jaws" do not return completely to the open position. As this memory loss or creep progresses the valve begins to cycle more rapidly, with consequent undesirable loss of flow rate, and finally the valve ceases to function entirely.

Additionally, the "jaw-type" valves described are susceptible to fouling by debris becoming caught at the corners (side margins) of the mouth opening. When the jaws attempt to close on the debris at the corners, they are held at a partially open position and are then unable to either reopen or close completely. Consequently, the cleaner will cease to function until it is shut off, the debris removed and then restarted.

SUMMARY OF THE INVENTION

The invention relates to a cleaning device of the general type described having a valve in the form of a mouth having a pair of lips biased to an open position by the inherent elasticity of the plastic material forming a portion or all of the valve. In accordance with this invention an auxiliary biasing means with low creep properties is applied to the lips of the valve to augment the biasing action of the elastic valve material which is susceptible to creep. The auxiliary biasing means functions to compensate for the memory loss during a cycle of operation of the valve by returning the valve lips to their completely open position when the operation of the unit is stopped, so that during the at-rest period prior to the next cycle the plastic material can reestablish its memory. Thereby the valve is capable of sustained operation despite the limited memory of the plastic material.

As another feature of this invention where the lips themselves are comprised of flexible material, the auxiliary biasing means is designed to apply inward pressure at the margins between the lips forming the mouth of the valve, thereby to urge the mouth open. Advantageously, this biasing means comprises a elastic band circling the body of the valve downstream of the mouth to press inwardly against a pair of lever bars, each extending along a respective side of the jaw up to the corner of the mouth, thereby to thereby yielding apply the inward pressure at the margins between the lips.

Also in accordance with this invention means are provided upstream of the valve to channel the flow of any debris in the water stream toward the center of the valve opening and away from the corners of the mouth. The channeling means desirably comprises a funnel with the smaller end confronting the mouth of having a diameter smaller than the distance across the mouth when the of having a diameter smaller than the distance across the mouth when the mouth is open. Advantageously, the funnel is porous so that water flow through the mouth of the valve (including the corners) is not impeded.

DETAILED DESCRIPTION OF THE PREFERRED EMBODIMENT

Figure 1:
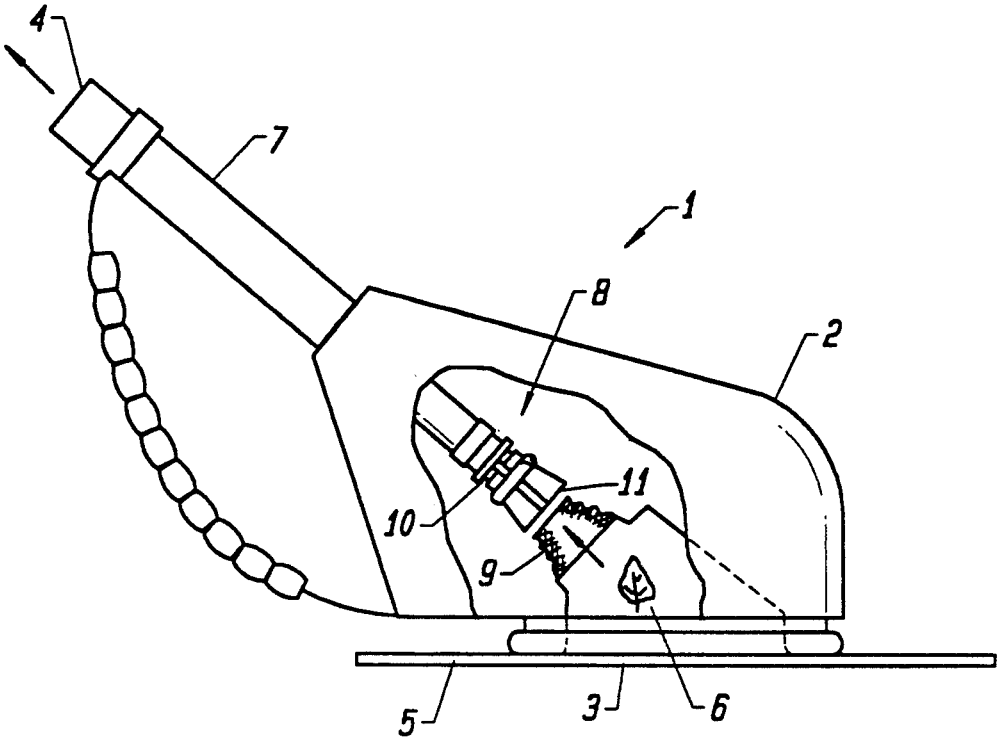
FIG. 1 is a partially sectional view of a swimming pool cleaner of the present invention.

The following description illustrates the manner in which the principles of the invention are applied but is not to be construed as limiting the scope of the invention.

referring to FIG. 1 of the drawings, reference numeral 1 generally indicates a swimming pool cleaner comprising a head 2 having an inlet 3 and an outlet 4. A flexible circular surface-engaging disc 5 surrounds the inlet 3. The flow passage between the inlet 3 and the outlet 4 includes an inlet chamber 6 immediately upstream of inlet 3 and a rigid tubular section 7 upstream of inlet chamber 6. A valve 8 is located in the flow passage at the upstream end of tubular section 7. At the downstream end of inlet chamber 6 and immediately upstream of and confronting valve 8 is channeling funnel 9.

As best seen in FIGS. 2–5, valve 8 is a made from suitable resilient or flexible plastic material and is preferably injection molded as a unitary body of conventional elastomer typically susceptible to creep from repeated stress. Valve 8 is constituted of a generally circular throat portion 10 located at the downstream end at which it is connected to tubular section 7. Upstream of the throat portion valve 8 becomes increasingly more elliptical in cross-section to form a mouth 11 having two opposed lips 12 which each flatten at their margins to either side along which they are connected at seams 13. The configuration of the mouth at either side is thus generally convex or arched outwardly of the lips. With this configuration, an inward compressive force at the margins between the lips will create an opening force on the mouth that may be utilized for the purposes of this invention as will be discussed.

Figure 2:
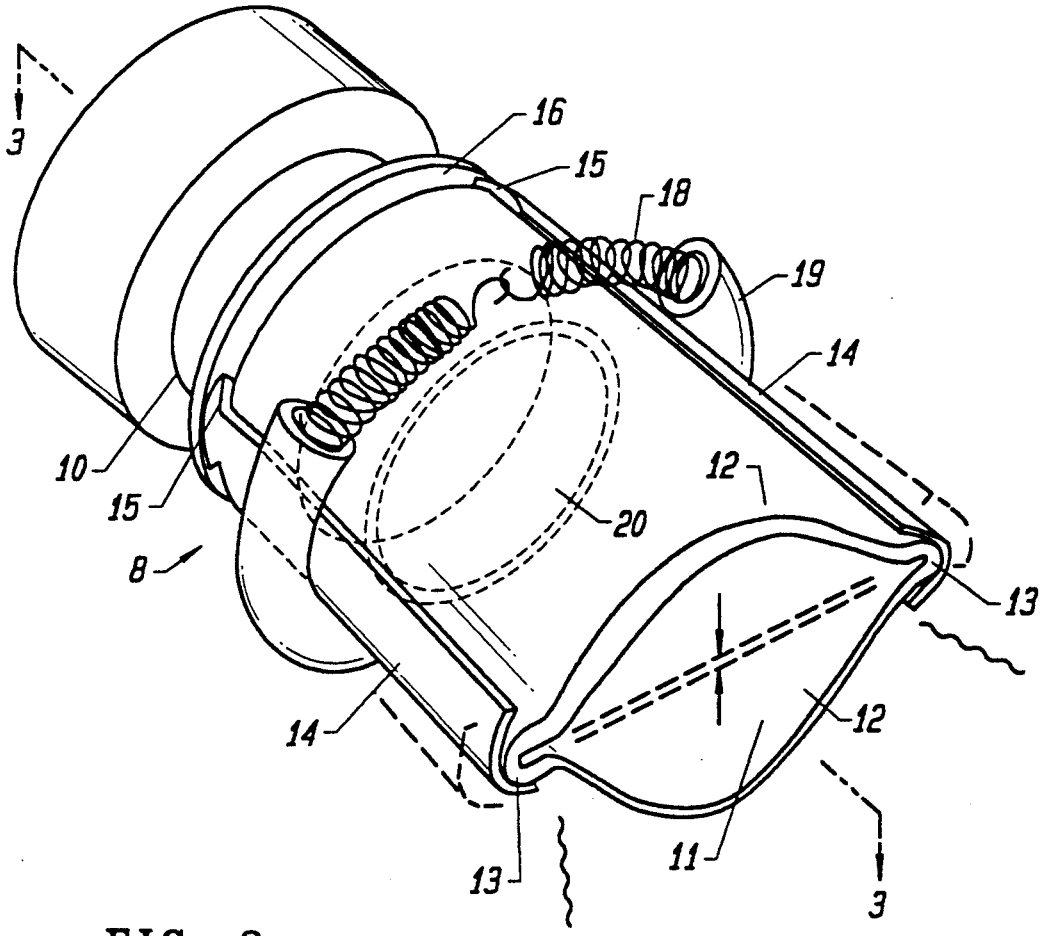
FIG. 2 is an isometric view of an embodiment of a valve in accordance with this invention for the pool cleaner of FIG. 1.
Figure 4:
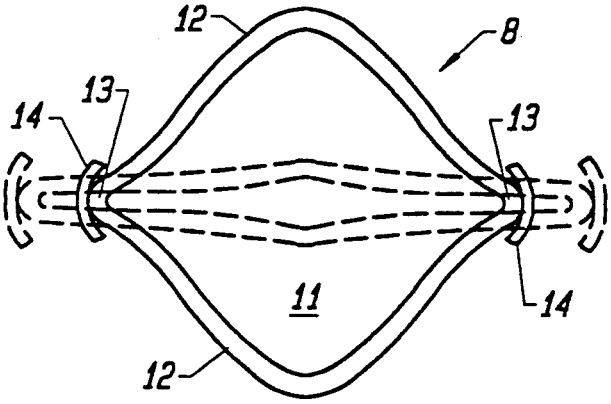
FIG. 4 is a front view of the valve of FIGS. 2 and 3 showing the valve mouth and FIG. 5 is a full side view of the valve of FIGS. 2–4, together with the associated channeling funnel (in dashed outline).
Figure 5:
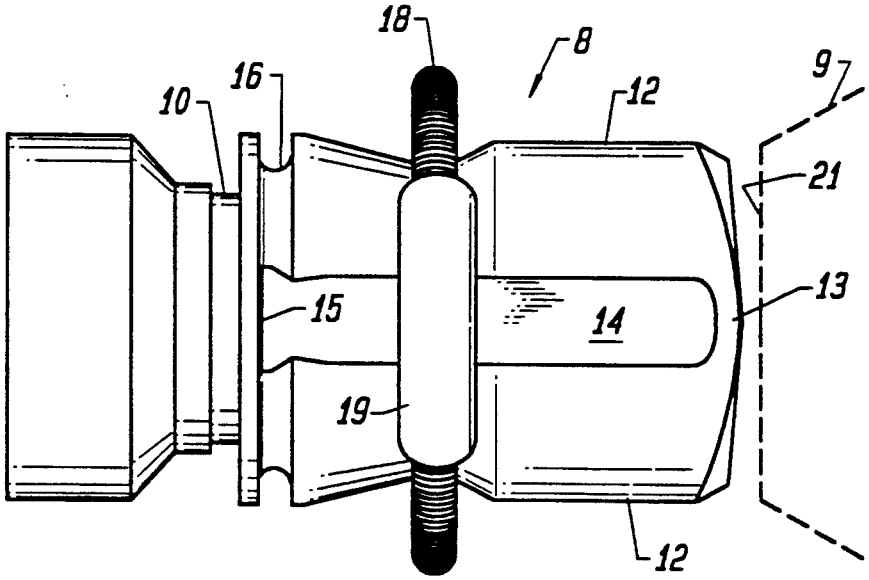

As best seen in FIG. 4 in outline view, upon closure of mouth 11, lips 12 extend outwardly to either side, flattening and coming together at their upstream ends to cut off flow through the valve. The inherent resilience of the valve material biases lips 12 to a normal open position, as best shown in FIGS. 2 and 4, when there is no flow through the valve. Flow of water through the open valve will create the closing force on lips 12 that will overcome the resilience of the valve to close lips 12 to shut off flow.

In use, outlet 4 is connected to a flexible suction hose (not shown) which in turn is connected to the suction intake of a swimming pool filtration pump. When suction is applied to outlet 4, water flows into inlet 3 to inlet chamber 6. From there the water flows into and through valve 8, then in the open position to and through tubular section 7 to outlet 4. The water flow creates a differentially lower pressure on the interior surfaces of lips 12 compared to the pressure at the exterior surfaces. And when a critical flow velocity is reached, that differential becomes sufficient to overcome the inherent resilience biasing lips 12 to the open position and the lips close to stop the water flow. This closure is rapid and due to the inertia of the water flow a "water hammer" effect is created in tubular section 7 that momentarily increases the pressure at the interior surfaces of lips 12. The interior and exterior pressure on lips 12 is thus at least partially equalized and consequently after a brief period the resilience of lips 12 forces them again to the open position. Upon return of valve 8 to the open position the cycle is repeated resulting in the intermittent opening and closing of valve 8. The intermittent flow interruption causes the cleaner to move step-wise along the pool surfaces to clean them.

The description to this point is of an embodiment of the type of pool cleaner and valve described in U.S. Pat. No. 4,769,867. It will be appreciated that the various other embodiments described in that patent may be utilized in the present invention as now more fully detailed, including those embodiments in which only portions of the valve mouth (e.g. membranes at either side of the valve lips or "jaw-like members") are composed of resilient plastic serving to bias the valve to the open position.

Figure 3:
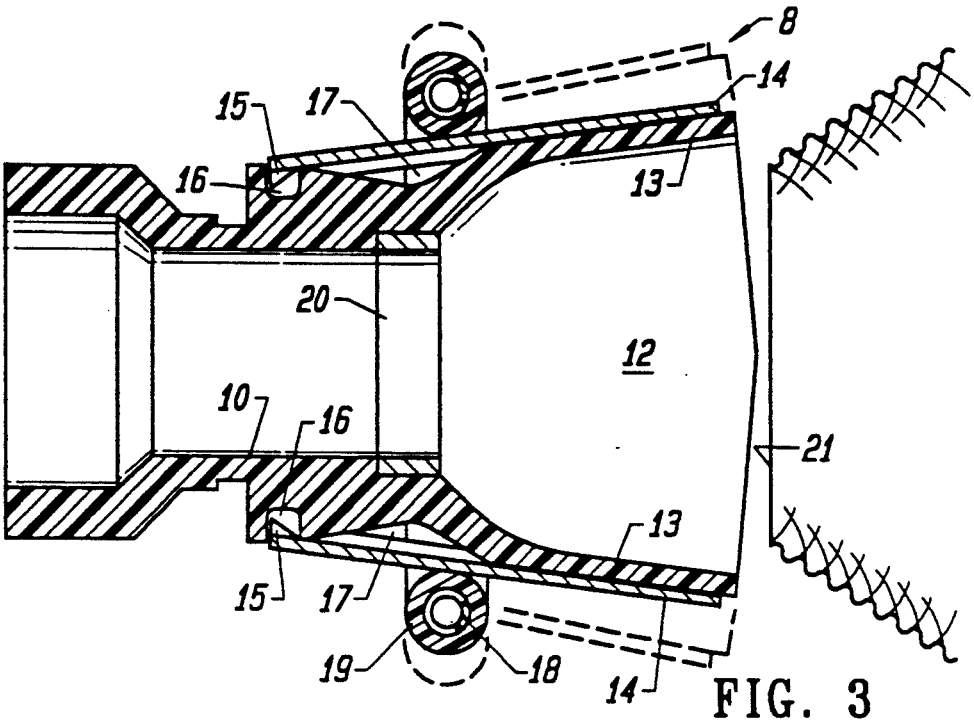
FIG. 3 is a sectional side view of the valve of FIG. 2 taken along line 3—3 also showing in sectional view an associated channeling funnel in accordance with this invention.

As seen in FIGS. 2–5 a rigid lever or compression bar 14, preferably composed of steel extends from throat portion 10 of valve 8 upstream along each seam 12 up close to the opening of mouth 11. A detent 15 on the upstream end of each bar 14 mates with annular groove 16 in valve 8 to retain each bar 14 in position and to serve as a fulcrum point for lever bars 14. As seen in FIG. 3, there is a annular depression 17 in the outer surface of valve 8 for a distance upstream of groove 16 which is bridged by each of bars 14. Upstream of groove 16 and at the location of annular depression 17 elastic band 18 under tension encircles valve 8 and overlies lever bars 14. Elastic band 18 is coil spring made of spring steel wire. Protective tubular plastic sleeves 19 surround band 16 where it overlies bars 14.

The compressive force of band 18 against bars 14 bias them inwardly against seams 12 located upstream of depression 17. As seen in FIGS. 2 and 4, interiorly of the throat portion 10 of valve 8 and below depression 17 is ring 20 mounted in bracing contact with the interior of the throat portion 10. Ring 20 serves to hold throat portion 10 from deforming when lips 11 move to the closed position and to reinforce the body of valve 8 at the fulcrum points at groove 16.

The auxiliary biasing force thus described is substantially smaller than the primary biasing force of the elastomer of which valve 8 is comprised as its purpose is simply to obtain a proximate restoration of the valve to its original open position when it is at rest in periods of non-use. Additionally, the auxiliary biasing force must be sufficiently small to still allow the closing force created by water flow through the valve to overcome the total force biasing lips 12 to the open position.

Other low creep auxiliary biasing arrangements may be employed, as will be apparent to those skilled in the art, for augmenting the high creep bias. Other arrangements for applying a low creep compressive biasing force against convex margins may be employed. Alternatively a low creep tension force may be applied directly to one or both lips urging them apart, e.g. by a lever arm connected directly to the lip that is properly mounted and biased to urge the lip outward.

For the auxiliary bias any low creep elastic materials can be utilized, preferably metal, and typically materials with a strain at their elastic limit (increase in length over original length in the relaxed state) or below 0.5. Elastic materials with a strain at the elastic limit of less than 0.2 are desirable and those below 0.1 are preferred.

By practice of this invention proper operation of elastomerically biased valves can be achieved over much longer periods, without unacceptable acceleration of the cycling rate. Eventually, even with the present invention, such valves may deform to an unacceptable degree, but its use can result in commercially satisfactory performance that is otherwise cannot be achieved.

Turning now to the debris channeling means of this invention, as seen in FIGS. 1 and 3, the smaller diameter end 21 of a funnel 9 in the shape of a conical section confronts mouth 11 of valve 8. It will be seen that the diameter of end 21 of funnel 9 is slightly smaller than the distance between the margins between lips 12 at seams 13 when mouth 11 is in the open position and that marginal portions of lips 12 extend even further to the outside of the margins of funnel 9 at end 21 when mouth 11 is closed. Thus, flow from inlet 3 arriving at mouth 12 is channeled away from the marginal portions of lips 12 to either side, thus diverting any debris in the flow toward the center of the mouth and thereby preventing fouling of the valve by debris caught at the lip margins. Advantageously, funnel 9 may be comprised of wire mesh or is otherwise porous so that water flow to the marginal portions of the mouth is not impeded. The debris channeling or diverting means may take alternative configurations as, for example, a rectangularly shaped funnel or simply a pair of separate inwardly inclined or converging porous walls confronting the valve mouth one at each side of the mouth and each having its downstream end located inwardly of a respective lip margin.

We claim:

1. A swimming pool cleaner comprising a cleaning head having a passage extending therethrough from an inlet, which in use engages the surface to be cleaned, to an outlet for connection to a flexible suction hose, a valve within the passage at the upstream end of a rigid section of the passage, the valve having:

a. a mouth comprising a pair of opposed lips, said lips being movable towards each other in response to water flow therethrough from an open position of the mouth permitting flow into said section to a closed position of the mouth to shut off flow into said section and resilient plastic portions biasing the lips to the open position, said plastic portions being susceptible to creep, and b. auxiliary biasing means having low creep characteristics, as compared to said plastic portions of said mouth, for urging the lips to substantially the fully open position when said device is at rest.

2. A swimming pool cleaner as in claim 1 and wherein said auxiliary biasing means is comprised of a material having a strain of less than 0.5 at the elastic limit of the material.

3. A swimming pool cleaner as in claim 2 and wherein said auxiliary biasing means is comprised of metal.

4. A swimming pool cleaner comprising a cleaning head having a passage extending therethrough from an inlet, which in use engages the surface to be cleaned, to an outlet for connection to a flexible suction hose, a valve within the passage at the upstream end of a rigid section of the passage, the valve having:

a. a mouth comprising a pair of opposed lips, said lips being movable towards each other in response to water flow therethrough from an open position of the mouth permitting flow into said section to a closed position of the mouth to shut off flow into said section and a resilient plastic wall portion to either side of said lips in the flow direction, said wall portions being generally concave outwardly of the sides of the lips in the flow direction and extending along said sides to connect and biasing the lips to the open position, said plastic portions being susceptible to creep, and b. auxiliary biasing means having low creep characteristics, as compared to said plastic portions of said mouth, for urging the plastic wall portions inwardly of said sides the lips, whereby to bias the lips to substantially the fully open position when said device is at rest.

5. A swimming pool cleaner as in claim 4 and wherein said valve mouth is composed of resilient plastic a unitary injection molded resilient plastic.

6. A swimming pool cleaner as in claim 4 and wherein said auxiliary biasing means is comprised of a material having a strain of less than 0.5 at the elastic limit of the material.

7. A swimming pool cleaner as in claim 6 and wherein said auxiliary biasing means is comprised of metal.

8. A swimming pool cleaner as in claim 7 and wherein said auxiliary biasing means is comprised of spring steel.

9. A swimming pool cleaner as in claim 4 and wherein said auxiliary biasing means comprises a compression bar extending in the flow direction along each of said elastic wall portions, each of said compression bars being biased to apply an inward compressive force on a respective wall portion.

10. A swimming pool cleaner as in claim 9 and wherein said auxiliary biasing means further comprises an elastic band of low creep material under tension encircling the valve and overlying said compression bars to apply an inward compressive force on the compression bars to apply said inward compressive force.

11. A swimming pool cleaner as in claim 10 and wherein the valve has a throat section downstream of the mouth having a fulcrum for each of the compression bars, said compression bars extend upstream from a respective fulcrum and the elastic band overlies the compression bars upstream of the fulcrums.

12. A swimming pool cleaner as in claim 11 and wherein said elastic band is comprised of spring steel.

13. A swimming pool cleaner as in claim 10 and wherein said valve mouth is composed of resilient plastic a unitary injection molded resilient plastic.

14. A swimming pool cleaner as in claim 4 and wherein the force of said auxiliary biasing means is of a sufficiently low magnitude that the total force biasing the lips to the open position may be overpowered by differential pressure created by flow through the valve to thereby close the mouth.

15. A swimming pool cleaner comprising a cleaning head having a passage extending therethrough from an inlet, which in use engages the surface to be cleaned, to an outlet for connection to a flexible suction hose, a valve within the passage at the upstream end of a rigid section of the passage, the valve having a mouth comprising a pair of opposed lips with margins to either side of said lips, said lips being movable towards each other in response to water flow therethrough from an open position of the mouth permitting flow into said section to a closed position of the mouth to shut off flow into said section, and means for biasing the lips to the open position, and means upstream of and confronting the valve mouth for channeling the flow of debris to the mouth interiorly of the side margins of the mouth.

16. A swimming pool cleaner as in claim 15, and wherein said channeling means comprises a funnel with the smaller end thereof confronting said mouth with the margins thereof positioned interiorly of the side margins of said mouth.

17. A swimming pool cleaner as in claim 16 and wherein said funnel is porous whereby to permit flow therethrough of water to the side margins of said mouth.

18. A swimming pool cleaner as in claim 15 and wherein said valve further comprises a resilient plastic wall portion to either side of said lips in the flow direction, said wall portions being generally concave outwardly of the sides of the lips in the flow direction and extending along said sides to connect and biasing the lips to the open position.

19. A swimming pool cleaner as in claim 18. and wherein said channeling means comprises a funnel with the smaller end thereof confronting said mouth with the margins thereof positioned interiorly of the side margins of said mouth.

20. A swimming pool cleaner as in claim 19 and wherein said funnel is porous whereby to permit flow therethrough of water to the side margins of said mouth.

* * * * *